US009565875B2

(12) United States Patent
Ashjaee

(10) Patent No.: US 9,565,875 B2
(45) Date of Patent: Feb. 14, 2017

(54) CIGAR CHILLER

(71) Applicant: Javad Ashjaee, Saratoga, CA (US)

(72) Inventor: Javad Ashjaee, Saratoga, CA (US)

( * ) Notice: Subject to any disclaimer, the term of this patent is extended or adjusted under 35 U.S.C. 154(b) by 252 days.

(21) Appl. No.: 14/452,320

(22) Filed: Aug. 5, 2014

(65) Prior Publication Data

US 2016/0040914 A1 Feb. 11, 2016

(51) Int. Cl.

| | |
|---|---|
| ***A24F 15/00*** | (2006.01) |
| ***A24F 19/00*** | (2006.01) |
| ***F25D 3/00*** | (2006.01) |
| ***A24F 19/10*** | (2006.01) |
| ***A24F 13/00*** | (2006.01) |

(52) U.S. Cl.

CPC ..... *A24F 19/10* (2013.01); *A24F 13/00* (2013.01); *A24F 15/00* (2013.01)

(58) Field of Classification Search

CPC ..... F25D 3/00; F25D 3/06; F25D 3/08; F25B 21/02; A24F 15/00; A24F 19/00; A24F 19/0035; A24F 19/14; A24F 13/04

See application file for complete search history.

(56) References Cited

U.S. PATENT DOCUMENTS

| | | | | |
|---|---|---|---|---|
| 747,121 | A | 12/1903 | Berriman | |
| 4,534,369 | A * | 8/1985 | Jenkins | A24F 19/10 131/235.1 |
| 2006/0091129 | A1* | 5/2006 | Colonna | F25D 3/08 219/439 |
| 2007/0012066 | A1* | 1/2007 | Kaplan | F25D 3/08 62/457.2 |
| 2010/0281909 | A1* | 11/2010 | Carpanzano | B67D 3/0009 62/386 |

FOREIGN PATENT DOCUMENTS

| | | |
|---|---|---|
| GB | 21955 | 0/1914 |
| GB | 2369493 A | 5/2002 |
| JP | 2009-14295 A | 1/2009 |
| SK | 206-2011 U1 | 4/2012 |
| WO | 2013/023716 A1 | 2/2013 |

* cited by examiner

*Primary Examiner* — Ryan J Walters
*Assistant Examiner* — Erik Mendoza-Wilkenfe
(74) *Attorney, Agent, or Firm* — Morrison & Foerster LLP

(57) ABSTRACT

A cigar cooler is disclosed that includes a housing having an upper surface with a pair of open channels each sized to receive a cigar. The housing includes an open central region for receiving a cooling medium such as ice or a frozen gel. During use, the cigar is placed in an open channel between inhalations to reduce the temperature of the cigar.

10 Claims, 4 Drawing Sheets

CIGAR CHILLER

TECHNICAL FIELD

The subject invention relates to a device that can keep cigars cool while they are being smoked.

BACKGROUND OF THE INVENTION

It has been known to cool cigars prior to lighting them up. However, such pre-cooling is not advisable because it causes the cigar to lose flavor, texture and softness. Such pre-cooling may even crack the cigar wrapper.

The subject invention relates to cooling a cigar during the process of smoking the cigar. Cigars get hot when they are smoked. Even a cigar that has been pre-cooled will get hot very quickly, particularly cigars with large diameters. There is an interest in keeping the temperature of the cigar at about 70 degrees Fahrenheit while smoking the cigar. Keeping the cigar cool maintains the flavors and leads to a more pleasurable experience.

SUMMARY OF THE INVENTION

A cigar cooler is disclosed that includes a housing having an upper surface with at least one longitudinally extending, open channel sized to receive a cigar. In the preferred embodiment, there are two open channels.

The subject invention further includes a means located within said housing for cooling the housing, such that the temperature of a lit cigar placed in the open channel will be lowered. In a preferred embodiment, the cooling means is defined by a chilled or frozen liquid or gel positioned inside the housing.

DETAILED DESCRIPTION OF THE PREFERRED EMBODIMENTS

Figure 1:
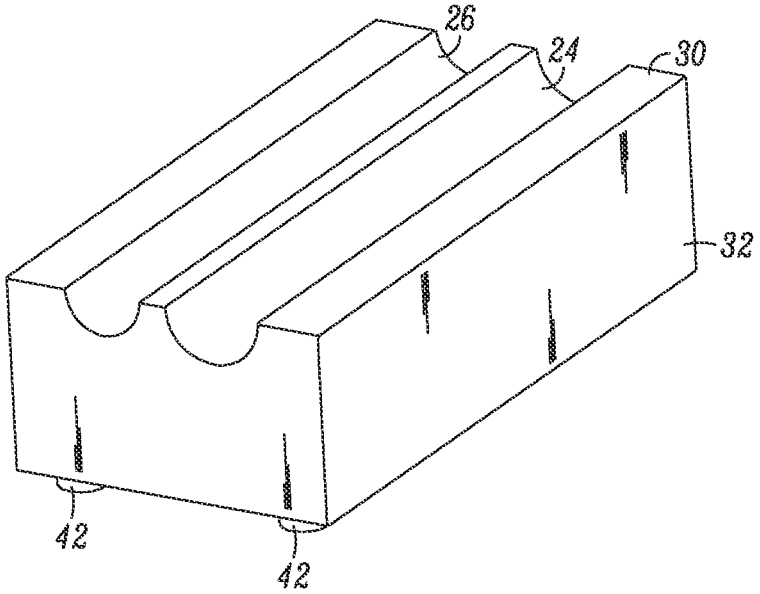
FIG. 1 is a perspective view of a cigar cooler of the subject invention.
Figure 2:
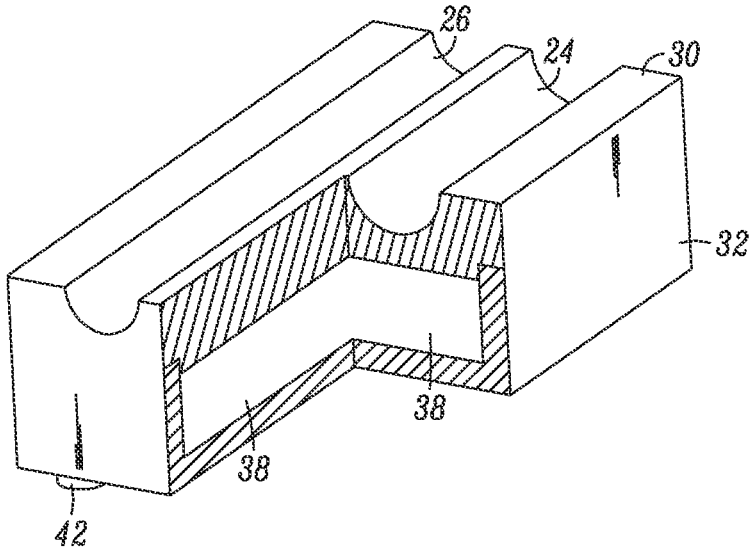
FIG. 2 is a perspective view of a cigar cooler, partially in section, of the cigar cooler of the subject invention.

Referring to FIGS. 1 to 3, the cigar cooler 10 of the subject invention includes a housing 20. The top surface 22 of the housing includes two, longitudinally extending open channels 24 and 26, sized to receive cigars. The channels can have the same diameter. Alternatively and as shown in Figures, one channel (24) can have a larger diameter than the other channel (26) to accommodate cigars having different diameters. The channels are preferably open at the ends of the housing so one or both of the ends of a cigar can extend beyond the ends of the housing.

Figure 3A:
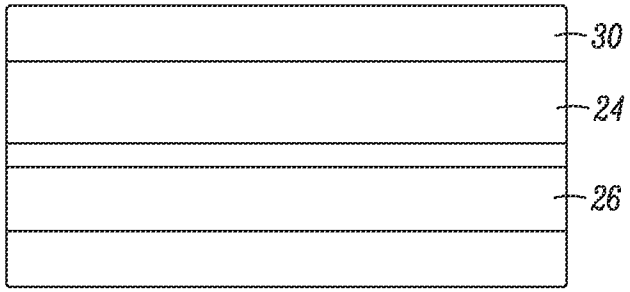
FIG. 3A is a top plan view of the cigar cooler.
Figure 3B:
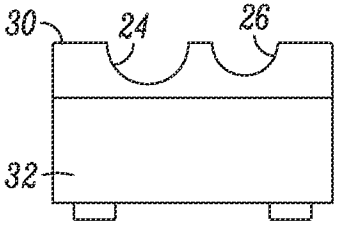
FIG. 3B is an end view of the cigar cooler
Figure 3C:
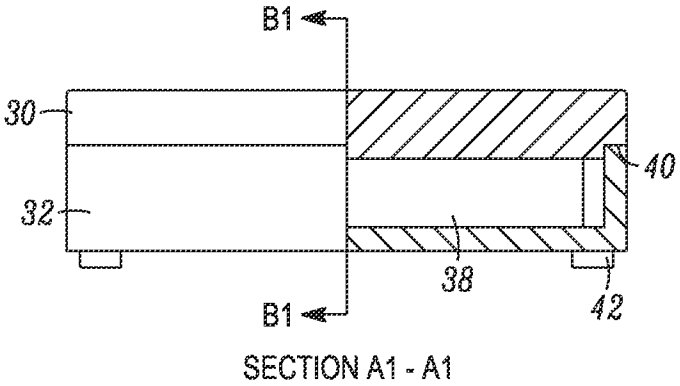
FIG. 3C is a side view of the cigar cooler, partially in section, along the lines A1-A1 of FIG. 3D.
Figure 3D:
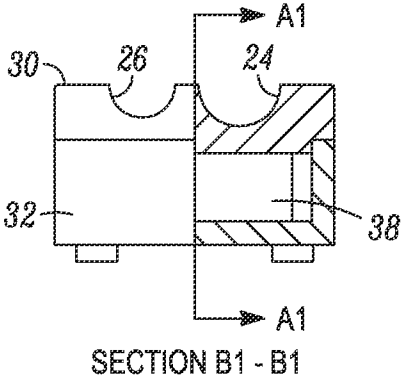
FIG. 3D is an end view of the cigar cooler, partially in section, along the lines B1-B1 of FIG. 3C.
Figure 3E:
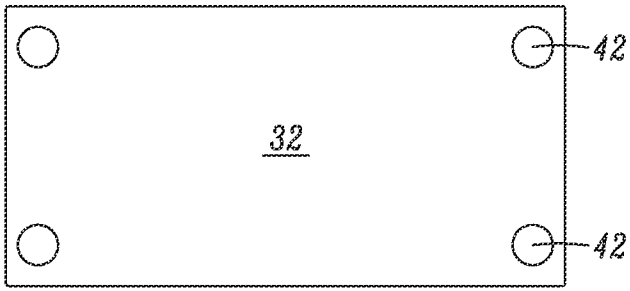
FIG. 3E is a bottom plan view of the cigar cooler.

In the preferred embodiment, the housing is formed from two elements, a lid 30 and a base 32. In this embodiment, the channels 24 and 26 are formed in the lid 30. As seen in FIGS. 2, 3C and 3D, the base includes an open region 38. The open region is configured to receive a cooling medium. Suitable cooling media include ice or a chilled or frozen gel. One approach would be to fill the base with water and then put the base in the freezer. In the alternative, gel packs that are frozen could be placed in the open region. It would also be possible to use other cooling means such as a thermoelectric, ceramic cooler that was electrically powered.

The lower surface of the lid 30 can include a lip 40 that mates with the base 32 for a snug fit. The bottom of the base can include feet 42.

The cooling medium should be selected and configured to maintain the cigar at a temperature of about 70 degrees Fahrenheit during smoking. In use, it is intended that the person smoking the cigar will periodically place the cigar into the channel on the cooler (between inhalations). In initial experiments, it was found that filling the opening 38 with a frozen gel produces sufficient cooling for about two hours of smoking.

Figure 4:
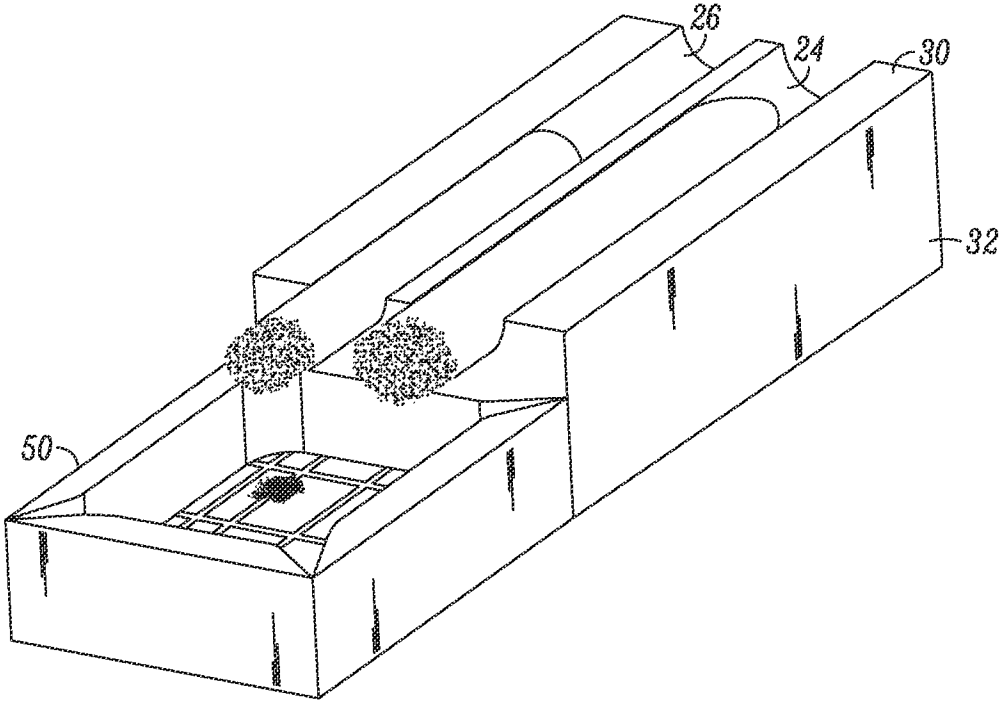
FIG. 4 is a perspective view of the cooler illustrated with an integral ash tray.

The cigar cooler can further be provided with an integral ashtray 50 as shown in FIG. 4. The ashtray is positioned to catch ashes that drop from the end of the cigar when it is being cooled.

While the subject invention has been described with reference to a preferred embodiment, various changes and modifications could be made therein, by one skilled in the art, without varying from the scope and spirit of the subject invention as defined by the appended claims.

What is claimed is:

1. A cigar cooler comprising:

a housing having a flat-bottomed base and an upper surface with at least one linear open channel sized to receive a cigar, said channel extending longitudinally and substantially parallel to the flat-bottomed base, wherein at least one end of the open channel extends to an outermost side edge of the housing at one end thereof so that the end of a cigar placed in the channel can extend beyond said outermost side edge of the housing; and cooling means within said housing for cooling the housing, such that the temperature of a lit cigar placed in the open channel will be lowered.

2. A cigar cooler as recited in claim 1 wherein the interior of the housing includes an open region filled with a chilled material to define the cooling means.

3. A cigar cooler as recited in claim 2 wherein the chilled material is water.

4. A cigar cooler as recited in claim 2 wherein the chilled material is a gel.

5. A cigar cooler as recited in claim 1 wherein the cooling means is a thermoelectric cooler.

6. A cigar cooler as recited in claim 1 further including an ash tray, integrated with the housing and aligned with an open end of the channel.

7. A cigar cooler comprising:

a two-part housing including a lid and a flat-bottomed base, said base having an open inner region, and with said lid having an upper surface with a pair of linear open channels each sized to receive a cigar, said channels extending longitudinally and substantially parallel to the flat-bottomed base, wherein at least one end of each open channel extends to an outermost side edge of the housing at one end thereof so that the end of a cigar placed in a channel can extend beyond said outermost side edge of the housing; and a cooling material positioned within the open inner region of the base for cooling the housing, such that the temperature of a lit cigar placed in one of the open channels will be lowered.

8. A cigar cooler as recited in claim 7 wherein the cooling material is water.

9. A cigar cooler as recited in claim 7 wherein the cooling material is a gel.

10. A cigar cooler as recited in claim 7 further including an ash tray, integrated with the housing and aligned with open ends of the channels.

* * * * *